US010553189B2

(12) United States Patent
Ichiki

(10) Patent No.: US 10,553,189 B2
(45) Date of Patent: Feb. 4, 2020

(54) KEYBOARD DEVICE AND ELECTRONIC KEYBOARD DEVICE

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/130,096

(22) Filed: Sep. 13, 2018

(65) Prior Publication Data

US 2019/0012996 A1 Jan. 10, 2019

Related U.S. Application Data

(63) Continuation of application No. PCT/JP2017/009902, filed on Mar. 13, 2017.

(30) Foreign Application Priority Data

Mar. 25, 2016 (JP) ..... 2016-061762

(51) Int. Cl.
*G10D 3/12* (2006.01)
*G10H 1/34* (2006.01)
(Continued)

(52) U.S. Cl.
CPC ..... *G10H 1/344* (2013.01); *G10B 3/12* (2013.01); *G10C 3/12* (2013.01); *G10H 1/34* (2013.01)

(58) Field of Classification Search
CPC ..... G10H 1/344; G10C 3/12
See application file for complete search history.

(56) References Cited

U.S. PATENT DOCUMENTS 4,914,999 A * 4/1990 Masubuchi ..... G10C 3/12 200/5 A
5,574,241 A * 11/1996 Kumano ..... G10C 3/12 84/433

(Continued)

FOREIGN PATENT DOCUMENTS

JP 0349595 U 5/1991
JP 2000330568 A 11/2000

(Continued)

OTHER PUBLICATIONS

International Search Report issued in Intl. Appln. No. PCT/JP2017/009902 dated May 23, 2017. English translation provided.

(Continued)

*Primary Examiner* — Robert W Horn
(74) *Attorney, Agent, or Firm* — Rossi, Kimms & McDowell LLP

(57) ABSTRACT

A keyboard device capable of securing a wider rotation region of a hammer is provided. The keyboard device includes: a key; a connection portion connected between the key and a frame, the connection portion including: a first region extending in a key-longitude direction and having a depressed portion caved upward; and a second region arranged so as to line up with the first region in the key-longitude direction, located in at least a part of a region other than the depressed portion, having flexibility in a yawing direction; and a hammer mechanism operated according to a strike of the key. A part of the hammer mechanism is positioned in the depressed portion in a state where the key is struck.

9 Claims, 8 Drawing Sheets

(51) Int. Cl.
*G10B 3/12* (2006.01)
*G10C 3/12* (2006.01)

(56) References Cited

U.S. PATENT DOCUMENTS

| | | | | |
|---|---|---|---|---|
| 5,929,357 | A * | 7/1999 | Masubuchi | G10C 3/12 235/145 R |
| 6,002,078 | A | 12/1999 | Yoshinaga | |
| 6,051,768 | A | 4/2000 | Masubuchi | |
| 6,133,517 | A | 10/2000 | Masubuchi | |
| 6,147,290 | A * | 11/2000 | Uno | G10C 3/12 84/423 R |
| 6,156,963 | A | 12/2000 | Masubuchi | |
| 6,369,309 | B1 | 4/2002 | Nishida | |
| 7,141,729 | B2 * | 11/2006 | Uno | G10H 1/346 84/236 |
| 7,208,668 | B2 * | 4/2007 | Shimoda | G10C 3/12 84/434 |
| 7,297,854 | B2 | 11/2007 | Nishida | |
| 7,297,855 | B2 | 11/2007 | Nishida | |
| 7,332,663 | B2 | 2/2008 | Nishida | |
| 7,465,863 | B2 | 12/2008 | Nishida | |
| 7,476,795 | B2 | 1/2009 | Toyama | |
| 7,485,798 | B2 | 2/2009 | Nishida | |
| 7,544,876 | B2 | 6/2009 | Toyama | |
| 7,586,030 | B2 | 9/2009 | Nishida | |
| 7,683,247 | B2 | 3/2010 | Nishida | |
| 7,750,222 | B2 * | 7/2010 | Osuga | G10C 3/12 84/423 R |
| 8,003,871 | B2 | 8/2011 | Kitajima | |
| 8,110,732 | B2 * | 2/2012 | Shimoda | G10C 3/12 84/423 R |
| 9,281,142 | B2 * | 3/2016 | Sawada | H01H 13/7065 |
| 9,406,284 | B2 | 8/2016 | Yoshizaki | |
| 9,449,586 | B2 | 9/2016 | Yamamoto | |
| 10,115,382 | B2 * | 10/2018 | Nishimura | G10C 3/12 |
| 2004/0261598 | A1 * | 12/2004 | Uno | G10H 1/346 84/235 |
| 2005/0056138 | A1 | 3/2005 | Osuga et al. | |
| 2014/0000444 | A1 * | 1/2014 | Kaneko | G10H 1/34 84/653 |
| 2018/0286368 | A1 * | 10/2018 | Tanoue | G10H 1/344 |
| 2019/0012996 | A1 * | 1/2019 | Ichiki | G10B 3/12 |
| 2019/0043459 | A1 * | 2/2019 | Ichiki | G10C 3/12 |

FOREIGN PATENT DOCUMENTS

| | | | |
|---|---|---|---|
| JP | 2001166773 | A | 6/2001 |
| JP | 2002073029 | A | 3/2002 |
| JP | 2006038941 | A | 2/2006 |
| JP | 2008191650 | A | 8/2008 |
| JP | 2011221560 | A | 11/2011 |
| JP | 2011253040 | A | 12/2011 |
| JP | 2012189872 | A | 10/2012 |

OTHER PUBLICATIONS

Written Opinion issued in Intl. Appln. No. PCT/JP2017/009902 dated May 23, 2017.

International Search Report issued in Intl. Appln. No. PCT/JP2017/010007 dated May 23, 2017. English translation provided.

Written Opinion issued in Intl. Appln. No. PCT/JP2017/010007 dated May 23, 2017.

Copending U.S. Appl. No. 16/130,244, filed Sep. 13, 2018 (a copy is not included because the cited application is not yet available to the public and the Examiner has ready access to the cited application).

English translation of Written Opinion issued in Intl. Appln. No. PCT/JP2017/009902 dated May 23, 2017, previously cited in IDS filed Sep. 13, 2018.

English translation of Written Opinion issued in Intl. Appln. No. PCT/JP2017/010007 dated May 23, 2017, previously cited in IDS filed Sep. 13, 2018.

Office Action issued in U.S. Appl. No. 16/130,244 dated Sep. 27, 2019.

* cited by examiner

KEYBOARD DEVICE AND ELECTRONIC KEYBOARD DEVICE

CROSS REFERENCE TO RELATED APPLICATIONS

This application is a U.S. continuation application filed under 35 U.S.C. § 111(a), of International Application No. PCT/JP2017/009902 filed on Mar. 13, 2017, which claims priority to Japanese Patent Application No. 2016-061762 filed on Mar. 25, 2016, the disclosures of which are incorporated by reference.

FIELD

The present invention relates to a technology for a keyboard device and an electronic keyboard device using the keyboard device.

BACKGROUND

Japanese Patent Application Publication No. 2006-38941 discloses a technology of a keyboard device including a keyboard structure and a hammer. In this keyboard device, the hammer rotates when the keyboard structure is struck.

SUMMARY

According to an embodiment of the present invention, a keyboard device is provided. The keyboard device includes: a key; a connection portion connected between the key and a frame, the connection portion including: a first region extending in a key-longitude direction and having a depressed portion caved upward; and a second region arranged so as to line up with the first region in the key-longitude direction, located in at least a part of a region other than the depressed portion, and having flexibility in a yawing direction; and a hammer mechanism having a hammer operated according to a strike of the key. A part of the hammer mechanism is positioned in the depressed portion in a state where the key is struck.

According to an embodiment of the present invention, an electronic keyboard device is provided. The electronic keyboard device includes: the keyboard device attached to the frame; a sensor sensing an operation on the key; and a sound-source portion generating a sound-wave signal according to an output signal of the sensor.

BRIEF DESCRIPTION OF DRAWINGS

FIG. 7A and FIG. 7B are drawings of a keyboard device according to a modified example of an embodiment of the present invention while FIG. 7A and FIG. 7B are side views showing a positional relationship between a white key and a hammer when the white key is in an unstruck state and a struck state, respectively.

DESCRIPTION OF EMBODIMENTS

Hereinafter, an electronic keyboard instrument 500 according to an embodiment of the present invention is explained in detail with reference to the drawings. Embodiments described below are merely examples of the embodiments of the invention, and the present invention is not limited to these embodiments.

Figure 1:
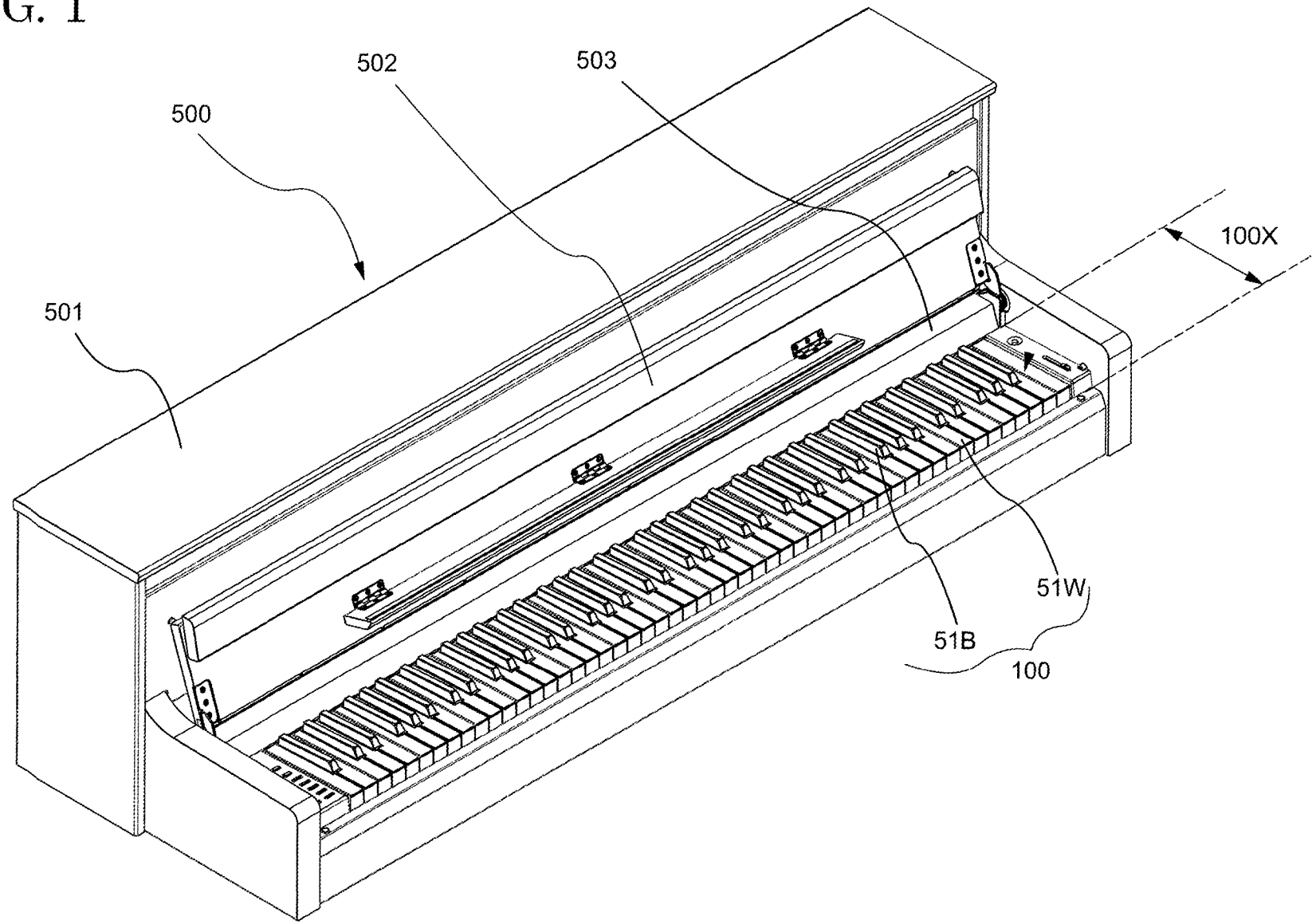
FIG. 1 is a perspective view of an electronic keyboard instrument having a keyboard device according to the First Embodiment of the present invention.

FIG. 1 is a perspective view of the electronic keyboard instrument 500 including a keyboard device 100 according to the First Embodiment of the present invention. As shown in FIG. 1, the electronic keyboard instrument 500 possesses a housing 501, the keyboard device 100 having white keys 51W and black keys 51B, a cover 502, and a cover 503.

First Embodiment

1. Outline Structure

The keyboard device 100 is attached to the housing 501. The cover 502 can be opened and closed with respect to the housing 501 and is configured to cover the whole of the keyboard device 100 in the closed state. The cover 503 is fixed so as not to be moved with respect to the housing 501 and configured to cover a part of the keyboard device 100. The keyboard device 100 has an outward portion 100X which is not covered by the cover 503 and a non-outward portion 100Y covered by the cover 503 (see FIG. 2).

Figure 2:
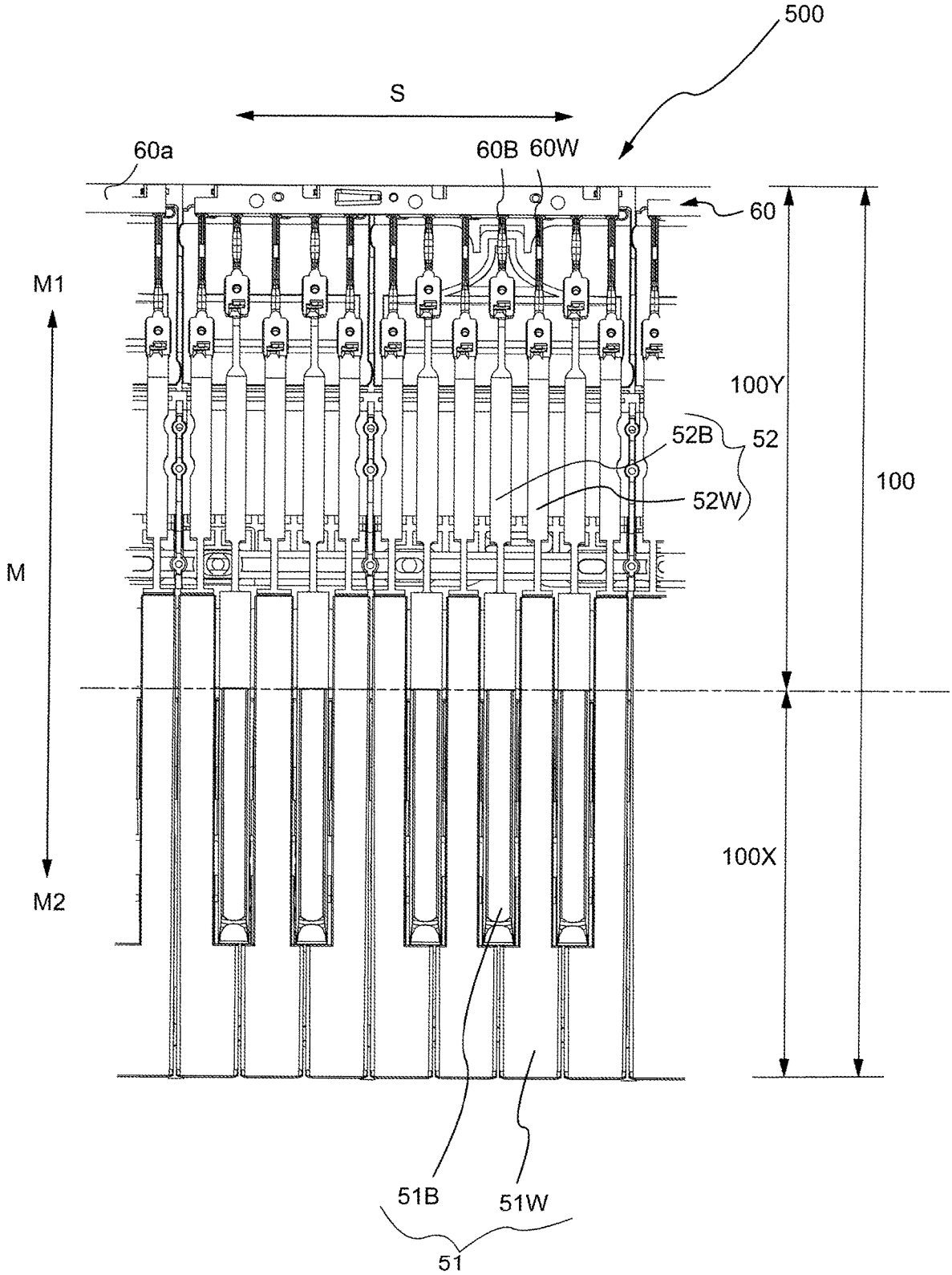
FIG. 2 is an enlarged plane view of a part of the electronic keyboard instrument.

FIG. 2 is an enlarged plane view of a part of the electronic keyboard device 500. In the following explanation, a direction from a player to a far side from the player along a key-longitude direction M of the keyboard device 100 is called a key-longitude back direction M1, and a direction from the far side from the player to the player is called a key-longitude front direction M2.

In the keyboard device 100, the keys 51 (white keys 51W and black keys 51B), connection portions 52 (white-key connection portions 52W and black-key connection portions 52B), and a frame 60 are arranged in this order from the front side to the far side in the key-longitude direction M. The keys 51 are portions which are struck by a user. The connection portions 52 are portions extending from the keys 51 in the key-longitude back direction M1 and connected between the keys 51 and the frame 60. A plurality of structures in which the key 51 and the connection portion 52 are connected is arranged to line up in a scale direction S.

The frame 60 is arranged at a position on a side of the key-longitude back direction M1 from the connection portion 52 in the key-longitude direction M. The frame 60 possesses a supporting portion 60*a*, a plurality of frame narrow-width portions 60W, and a plurality of frame narrow-width portions 60B. The supporting portions 60*a* extend in the scale direction S. The frame narrow-width portions 60W and the frame narrow-width portions 60B extend from the supporting portion 60*a* in a direction perpendicularly intersecting to the scale direction S.

A part of the key 51 corresponding to the outward portion 100X of the keyboard device 100 is arranged in an area visible from the outside (see also FIG. 1). The other portion of the key 51 and the connection portion 52 which correspond to the non-outward portion 100Y of the keyboard device 100 are arranged in an area covered by the cover 503 and invisible from the outside (see also FIG. 1).

2. Frame 11

Figure 3:
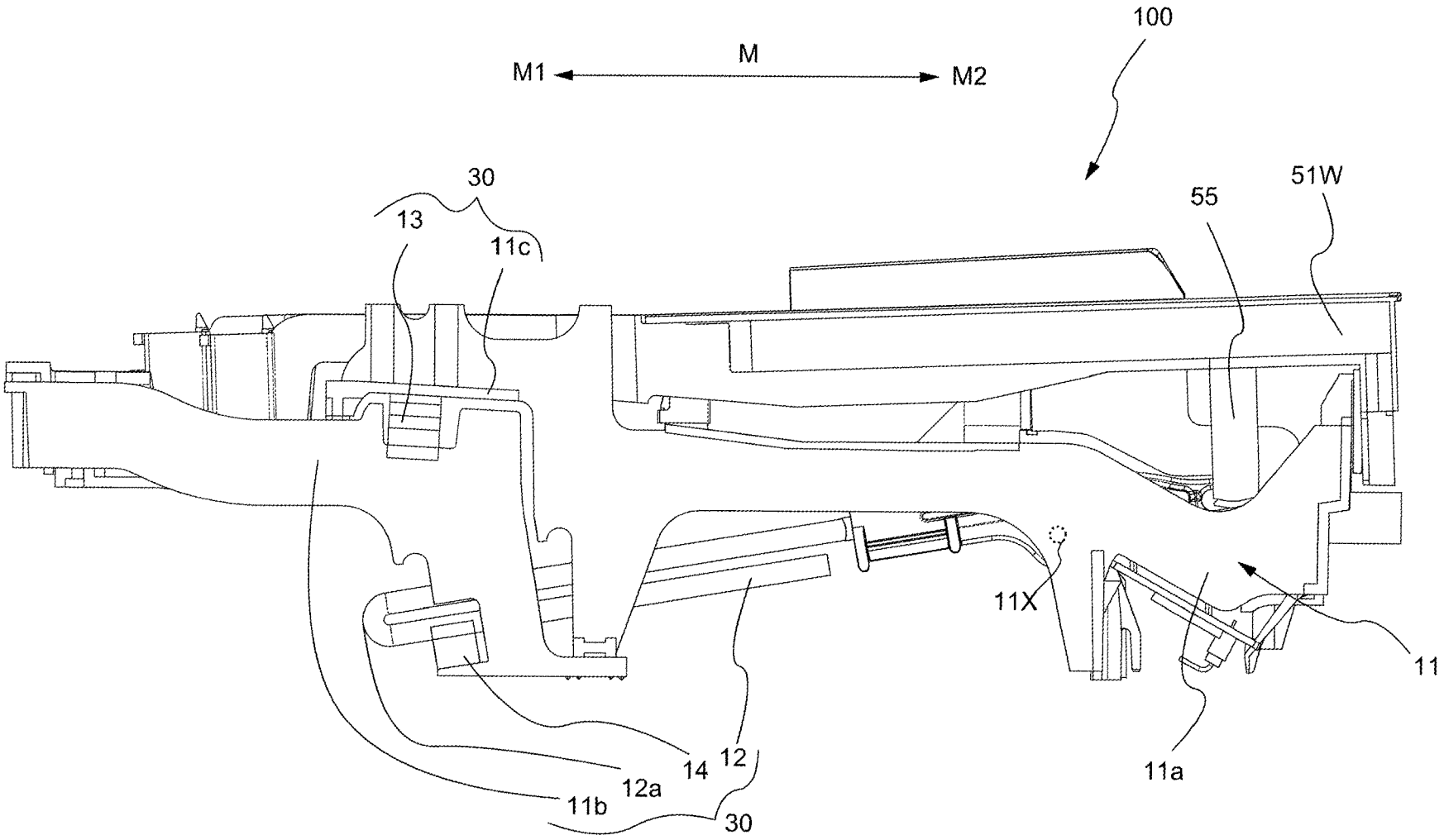
FIG. 3 is a side view of a keyboard device.

FIG. 3 is a side view of the keyboard device 100 obtained when the white key 51W is observed sidewise. As illustrated in FIG. 3, a frame 11 has a supporting-frame portion 11*a*, a supporting-frame portion 11*b*, and a supporting-frame portion 11*c*. The supporting-frame portion 11*b* and the supporting-frame portion 11*c* are fixed to the supporting-frame portion 11*a*, and the supporting-frame portions 11*a* to 11*c* are connected to one another so as not to be relatively moved.

(Supporting-Frame Portion 11*a*)

The supporting-frame portion 11*a* possesses a rotation axis 11*x* and rotatably supports a hammer 12. The hammer 12 rotates about a rotation axis 11*x* (displayed with a dotted line in FIG. 3) serving as a center. The frame 11 and the hammer 12 are configured so that, when a strike-transmitting portion 55 extending downward from the white key 51W descends, an edge portion 12*b* of the hammer 12 on a side of the key-longitude front direction M2 descends (see FIG. 6A and FIG. 6B) and a tip portion 12*a* on a side of the key-longitude back direction M1 pivots and ascends.

(Supporting-Frame Portion 11*b*)

The supporting-frame portion 11*b* supports the supporting portion 14. The supporting portion 14 receives and supports, from a downward direction, the portion on a side of the tip portion 12*a* of the hammer 12 which descends due to gravity when the white key 51W is in an unstruck state. The supporting portion 14 extends in the scale direction S. The hammer 12 is designed so that the portion on the side of the key-longitude back direction M1 is longer than the portion on the side of the key-longitude front direction M2 with respect to the axis 11X as a reference. Therefore, the hammer 12 is configured so that the tip portion 12*a* is positioned lower than the rotation axis 11*x* in an unstruck state due to gravity. In addition, the supporting portion 14 determines a lower limit of the pivoting range of the tip portion 12*a* of the hammer 12.

(Supporting-Frame Portion 11*c*)

The supporting-frame portion 11*c* supports a hammer stopper 13. The hammer stopper 13 makes contact with the portion of the hammer 12 on the side of the tip portion 12*a* which ascends when the white key 51W is in a struck state (FIG. 6B). The hammer stopper 13 as well as the supporting frame 11*c* also extend in the scale direction S.

3. Frame and Connection Portion

Figure 4A:
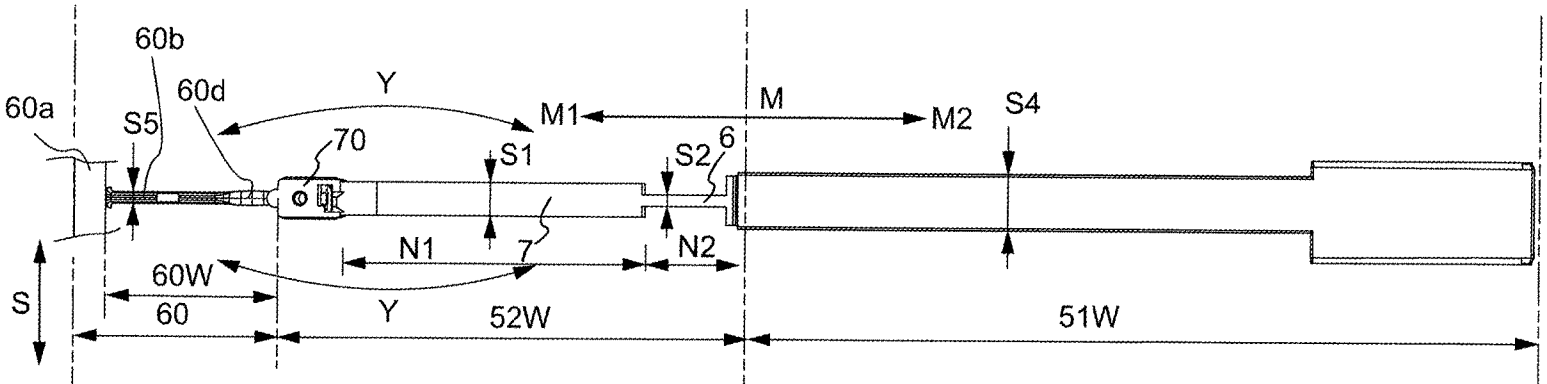
FIG. 4A and FIG. 4B are respectively a plane view and a side view of a white key.
Figure 4B:
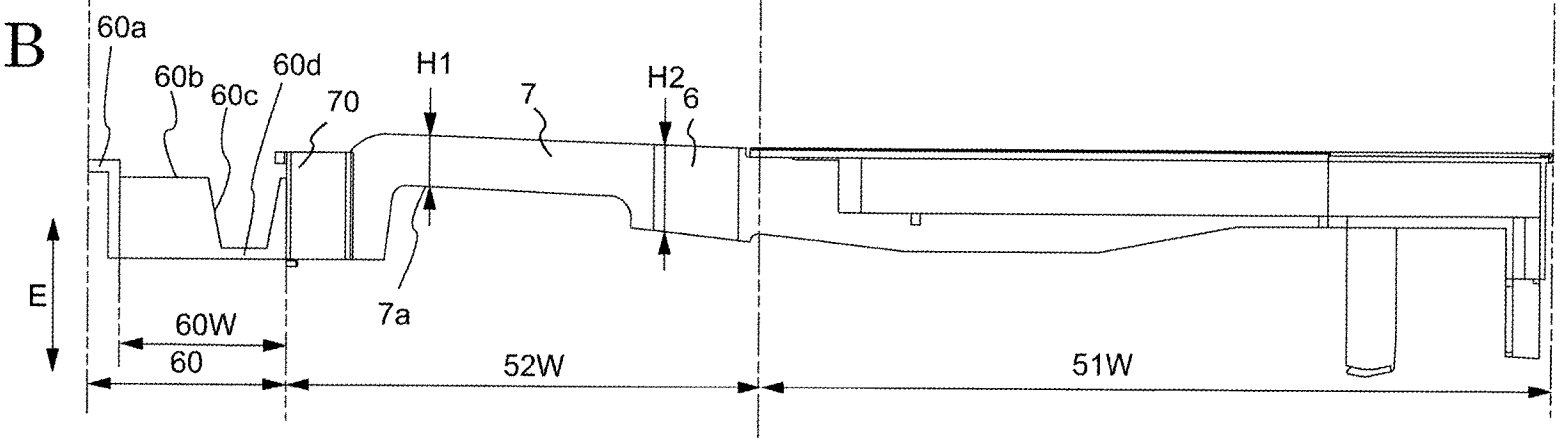
Figure 4C:
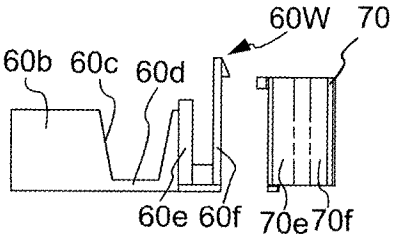
FIG. 4C is a side view showing a part of a structure of a linking portion and a frame narrow-width portion before linking.
Figure 5A:
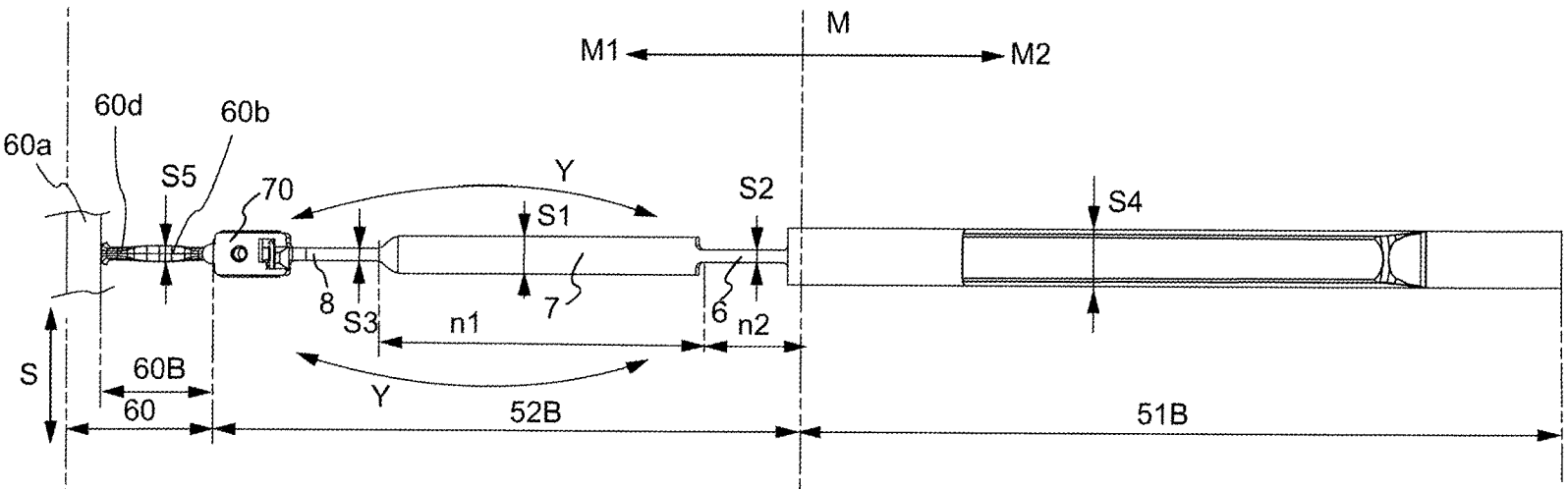
FIG. 5A and FIG. 5B are respectively a plane view and a side view of a black key.
Figure 5B:
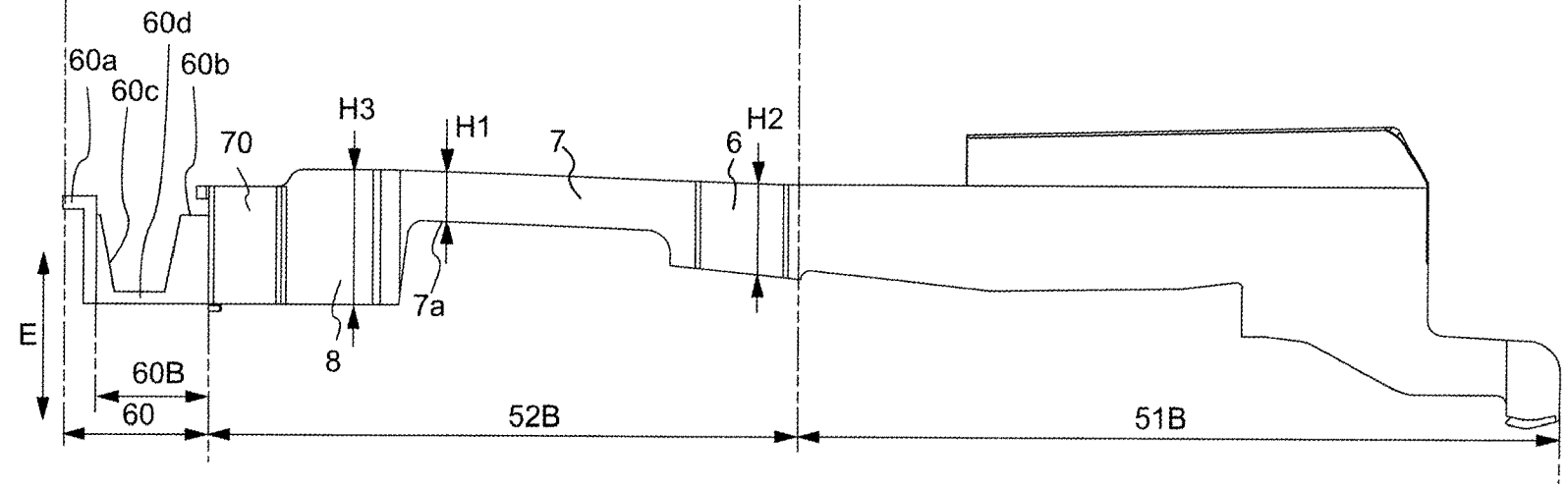

FIG. 4A is a plane view of the white key 51W, and FIG. 4B is a side view of the white key 51W. FIG. 4C is a side view showing a part of the structures of a linking portion 70 and the frame narrow-with portion 60W before linking. FIG. 5A is a plane view of the black key 51B, and FIG. 5B is a side view of the black key 51B. The white-key connection portion 52W connected to the white key 51W has a front-side narrow-width portion 6 (second region), a wide-width portion 7 (first region), and the linking portion 70, and the frame narrow-width portion 60W is provided to the frame 60. The black-key connection portions 52B connected to the black key 51B has a front-side narrow-width portion 6 (second region), a wide-width portion 7 (first region), and a back-side narrow-width portion 8 (second region), and the frame 60 possesses a frame narrow-width portion 60B.

3-1. Frame (Frame Narrow-Width Portion)

The frame narrow-width portion 60W has a flexible portion 60*b* extending from the supporting portion 60*a* and having flexibility in the scale direction S and a flexible portion 60*d* having flexibility in the scale direction S and the vertical direction E. Here, the portion other than the flexible portion 60*d* of the frame narrow-width portion 60W corresponds to the flexible portion 60*b*, and a cutoff portion 60*c* corresponds to a part of rims of the flexible portion 60*b* and the flexible portion 60*d*. The key 51 and the connection portion 52 are capable of rotating in the vertical direction E about the cutoff portion 60*c* (see FIG. 4B and FIG. 5B).

Note that the frame narrow-width portion 60W and the linking portion 70 shown in FIG. 4C are linked to each other. The linking is to performed by inserting a first insertion portion 60*e* of the frame narrow-width portion 60W into an insertion hole 70*e* of the linking portion 70 and inserting a second insertion portion 60*f* of the frame narrow-width portion 60W into an insertion hole 70*f* of the linking portion 70. The attachment-detachment mechanism of FIG. 4C is also applied to the attachment-detachment mechanism between the frame narrow-width portion 60B and the linking portion 70 with respect to the black key 51B.

3-2. White Key (Front-Side Narrow-Width Portion)

The front-side narrow-width portion 6 (also called a first narrow-width portion, a first low-rigidity portion, or a second region) is a portion extending from the white key 51W in the key-longitude back direction M1. A width S2 of the front-side narrow-width portion 6 in the scale direction S is smaller than a width S4 of the white key 51W in the scale direction S. In addition, the width S2 of the front-side narrow-width portion 6 in the scale direction S is adjusted to a size smaller than a thickness H2 of the front-side narrow-width portion 6 in the vertical direction E. In brief, the front-side narrow-width portion 6 is disposed so that a thin plate-shaped member is vertically arranged.

The front-side narrow-width portion 6 has lower rigidity in the scale direction S than the white key 51W, exhibits flexibility in the scale direction S and a yawing direction Y, and is readily bent because the width S2 in the scale direction S is small. The structure of the front-side narrow-width portion 6 in the case of the black key 51B is the same as that in the case of the white key 51W.

(Wide-Width Portion)

The wide-width portion 7 (also called a high-rigidity portion or a first region) is a portion extending from the front-side small-width portion 6 on the side of the white key 51W in the key-longitude back direction M1. A width S1 of the wide-width portion 7 in the scale direction S is larger than the width S2 of the front-side narrow-width portion 6 in the scale direction S.

The wide-width portion 7 has higher rigidity in the scale direction S than the front-side narrow-width portion 6 because the width S1 in the scale direction S is large. Note that the width S1 of the wide-width portion 7 in the scale direction S is set to be smaller than the width S4 of the key 51 in the scale direction S.

In addition, the wide-width portion 7 has a depressed portion 7*a* caved upward in a side view. Rigidity of the wide-width portion 7 is reduced due to the depressed portion 7*a*. However, high rigidity can be maintained because the wide-width portion 7 is fabricated so as to have the width S1 larger than that of the front-side narrow-width portion 6. The front-side narrow-width portion 6 and the frame narrow-width portion 60W may be formed in at least a part of the region other than the depressed portion 7*a*.

Note that the width S1 of the wide-width portion 7 in the scale direction S is adjusted to have a size smaller than a thickness H1 of a thin portion in the vertical direction E in which the depressed portion 7*a* is provided to the wide-width portion 7. In brief, the wide-width portion 7 is disposed so that a thin plate-shaped member is vertically arranged. In addition, the thickness H1 of the wide-width portion 7 in the vertical direction E is smaller than the thickness H2 of the front-side narrow-width portion 6 in the vertical direction E. The structure of the wide-width portion 7 of the black key 51B is the same as that of the white key 51W.

3-3. Black Key (Wide-Width Portion)

Hereinafter, the black key 51B is explained with reference to FIG. 5A and FIG. 5B. A length n1 of the wide-width portion 7 of the black-key 51B in the key-longitude direction M is set to be shorter than a length N1 of the wide-width portion 7 of the white-key 51W in the key-longitude direction M. A reason is that the length of the black key 51B in the key-longitude direction M is set to be shorter than that of the white key 51W. Additionally, the lengths n1 and N1 of the wide-width portion 7 in the key-longitude direction M are set to be respectively longer than lengths n2 and N2 of the front-side narrow-width portion 6 in the key-longitude direction M in both of the black key 51B and the white key 51W.

(Back-Side Narrow-Width Portion)

The back-side narrow-width portion 8 (also called a second narrow-width portion, second low-rigidity portion, or a second region) is a portion extending from the wide-width portion 7 in the key-longitude back direction M1. A width S3 of the back-side narrow-width portion 8 in the scale direction S is smaller than the width S1 of the wide-width portion 7 in the scale direction S and the width S4 of the key 51 in the scale direction S. Moreover, the width S3 of the back-side narrow-width portion 8 in the scale direction S is adjusted to have a size smaller than a thickness H3 of the back-side narrow-width portion 8 in the vertical direction E. In brief, the back-side narrow-width portion 8 is disposed so that a thin plate-shaped member is vertically arranged.

It can be said that the back-side narrow-width portion 8 has lower rigidity in the scale direction S than the wide-width portion 7, has flexibility in the scale direction S and the yawing direction Y, and has a shape readily bent in the scale direction S because of the small width S3 in the scale direction S.

In the present embodiment, the width S3 of the back-side narrow-width portion 8 in the scale direction S is set to be substantially the same as the width S2 of the front-side narrow-width portion 6 in the scale direction S. However, the width S3 of the back-side narrow-width portion 8 in the scale direction S may be larger or smaller than the width S2 of the front-side narrow-width portion 6 in the scale direction S.

As described above, the width S2 of the front-side narrow-width portion 6 in the scale direction S is smaller than the width S1 of the wide-width portion 7 in the scale direction S. Hence, the front-side narrow-width portion 6 has lower rigidity in the scale direction S than the wide-width portion 7, has flexibility in the scale direction S and the yawing direction Y, and is readily bent. The width S1 of the wide-width portion 7 in the scale direction S is larger than the width S3 of the back-side narrow-width portion 8 in the scale direction S and the width S5 of the frame narrow-width portions 60W and 60B in the scale direction S. Therefore, the wide-width portion 7 has higher rigidity than the back-side narrow-width portion 8 in the scale direction S. Moreover, the thickness H1 of the wide-width portion 7 in the vertical direction E is smaller than the thickness H3 of the back-side narrow-width portion 8 in the vertical direction E.

The white key 51W according to the present embodiment has a structure in which the front-side narrow-width portion 6 is arranged on the side of the key-longitude front direction M2 (front side) of the wide-width portion 7, while the frame narrow-width portion 60W is arranged on the side of the key-longitude back direction M1 (far side) of the wide-width portion 7. When the white key 51W is deformed in the yawing direction Y, the positional relationship between the connection portion 52 (see FIG. 2) and the frame 60 is shifted. The front-side narrow-width portion 6 and the frame narrow-width portion 60W are deformed to provide a function to suppress the influence of the shift of the positional relationship. When the front-side narrow-width portion 6 is compared with the frame narrow-width portion 60W, the front-side narrow-width portion 6 closer to the white key 51W significantly contributes to realization of the function. Hence, the supporting portion 60*a*, the flexible portion 60*d*, and the wide-width portion 7 may be arranged so as to line up in the key-longitude direction M, and the flexible portion 60*b* and the linking portion 70 may not be employed.

Additionally, the black key 51B according to the present embodiment has a structure in which the front-side narrow-width portion 6 is arranged on the side of the key-longitude front direction M2 (front side) from the wide-width portion 7, while the back-side narrow-width portion 8 and the frame narrow-width portion 60B are arranged on the side of the wide-width portion 7 in the key-longitude front direction M1 (far side) of the wide-width portion 7. When the black key 51B is deformed in the yawing direction Y, the positional relationship between the connection portion 52 (see FIG. 2) and the frame 60 is shifted. The front-side narrow-width portion 6, the back-side narrow-width portion 8, and the frame narrow-width portion 60B are deformed to provide a function to suppress the influence of the shift of the positional relationship. When the front-side narrow-width portion 6 is compared with the back-side narrow-width portion 8 and the frame narrow-width portion 60B, the front-side narrow-width portion 6 closer to the black key 51B significantly contributes to realization of the function. Hence, the supporting portion 60*a*, the flexible portion 60*d*, and the wide-width portion 7 may be arranged so as to line up in the key-longitude direction M, and the flexible portion 60*b*, the linking portion 70, and the back-side narrow-width portion 8 may not be employed.

3-3. Attachment and Detachment Mechanism

In the connection portion 52W of the white key 51W, the front-side narrow-width portion 6, the wide-width portion 7, the linking portion 70 are arranged in this order in the key-longitude direction M, and the linking portion 70 is connected to the frame narrow-width portion 60W. Among these elements, the front-side narrow-width portion 6, the wide-width portion 7, and the linking portion 70 are integrally formed. The linking portion 70 integrally formed with the wide-width portion 7 is linked to the frame narrow-width portion 60W so as to be attachable thereto and detachable therefrom.

Note that the present embodiment is not limited to this structure: the front-side narrow-width portion 6, the wide-width portion 7, the linking portion 70, and the frame narrow-width portion 60W may have a structure in which these elements are integrally formed and cannot be attached to nor detached from one another or a structure in which these elements are individually prepared. Furthermore, similar to the black key 51B, the back-side narrow-width portion 8 may be provided to the connection portion 52W of the white key 51W.

In the connection portion 52B of the black key 51B, the front-side narrow-width portion 6, the wide-width portion 7, the back-side narrow-width portion 8, and the linking portion 70 are arranged in this order in the key-longitude direction M and the linking portion 70 is connected to the frame narrow-width portion 60B. Among these elements, the front-side narrow-width portion 6, the wide-width portion 7, the back-side narrow-width portion 8, and the linking portion 70 are integrally formed.

The linking portion 70 integrally formed with the back-side narrow-width portion 8 is linked to the frame narrow-width portion 60B of the frame 60 so as to be attachable thereto and detachable therefrom. The back-side narrow-width portion 8 is positioned in the key-longitude front direction M2 from the linking portion 70, and the frame narrow-width portion 60B is positioned in the key-longitude back direction M1 from the linking portion 70.

Note that the present embodiment is not limited to this structure: the front-side narrow-width portion 6, the wide-width portion 7, the back-side narrow-width portion 8, the linking portion 70, and the frame narrow-width portion 60W may have a structure in which these elements are integrally formed and cannot be attached to nor detached from one another or a structure in which these elements are individually prepared so as to be attached to or detached from one another. Furthermore, similar to the white key 51W, the connection portion 52B of the black key 51B may be structured without the back-side narrow-width portion 8.

Note that, although the structure is explained in this embodiment in which the connection portion 52W and the connection portion 52B each have the linking portion 70, the present embodiment is not limited to this structure: the wide-width portion 7 and the frame narrow-width portion 60W may be integrally formed without the linking portion 70. Moreover, the connection portion 52B may not have the linking portion 70, and the back-side narrow-width portion 8 and the frame narrow-width portion 60B may be integrally formed.

In the case of the white key 51W, the linking portion 70 is disposed between the wide-width portion 7 and the frame narrow-width portion 60W in the key-longitude direction M as described above. The linking portion 70 is arranged between the back-side narrow-width portion 8 and the frame narrow-width portion 60B in the key-longitude direction M in the case of the black key 51B. There is such a difference between the white key 51W and the black key 51B. However, the length of the frame narrow-width portion 60W in the key-longitude direction M is substantially the same as the summation of the lengths of the back-side narrow-width portion 8 and the frame narrow-width portion 60B in the key-longitude direction M.

As shown in FIG. 4B, the frame narrow-width portion 60W has the cutoff portion 60*c* caved downward. Furthermore, the frame narrow-width portion 60B has a cutoff 60*c* caved downward as shown in FIG. 5B. These cutoff portions 60*c* enable the white key 51W and the black key 51B to be readily rotated in the vertical direction E.

4. Hammer Mechanism

Figure 6A:
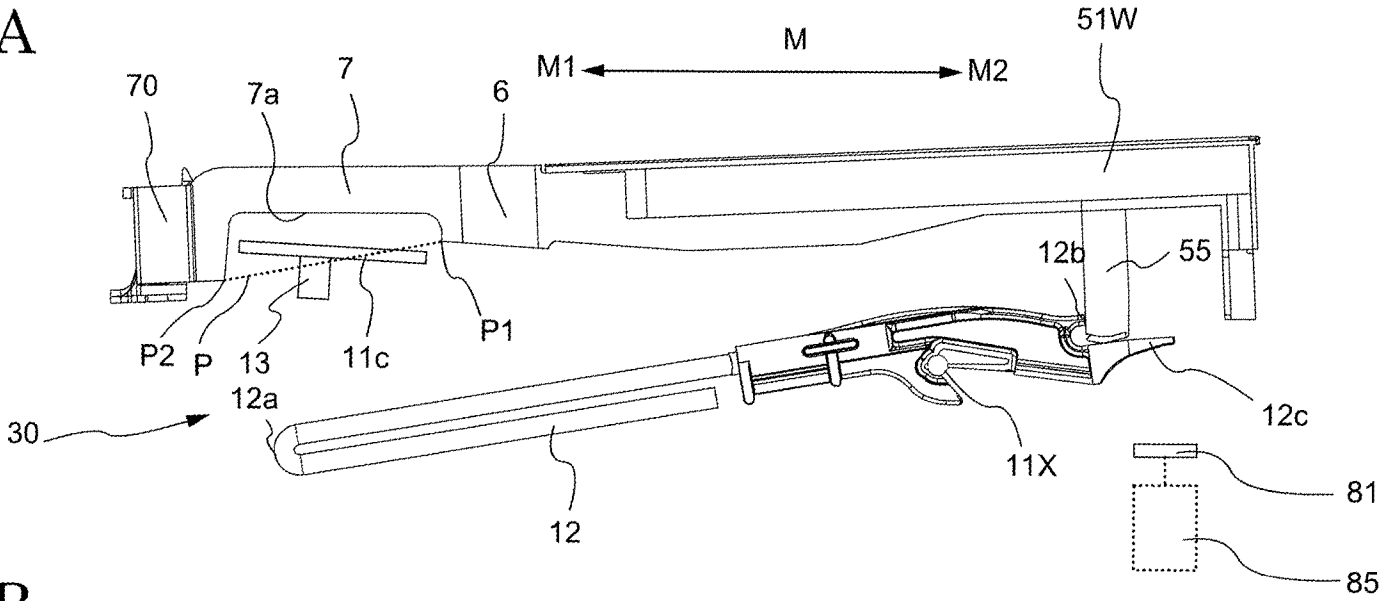
FIG. 6A and FIG. 6B are side views showing a positional relationship between a white key and a hammer when the white key is in an unstruck state and a struck state, respectively.
Figure 6B:
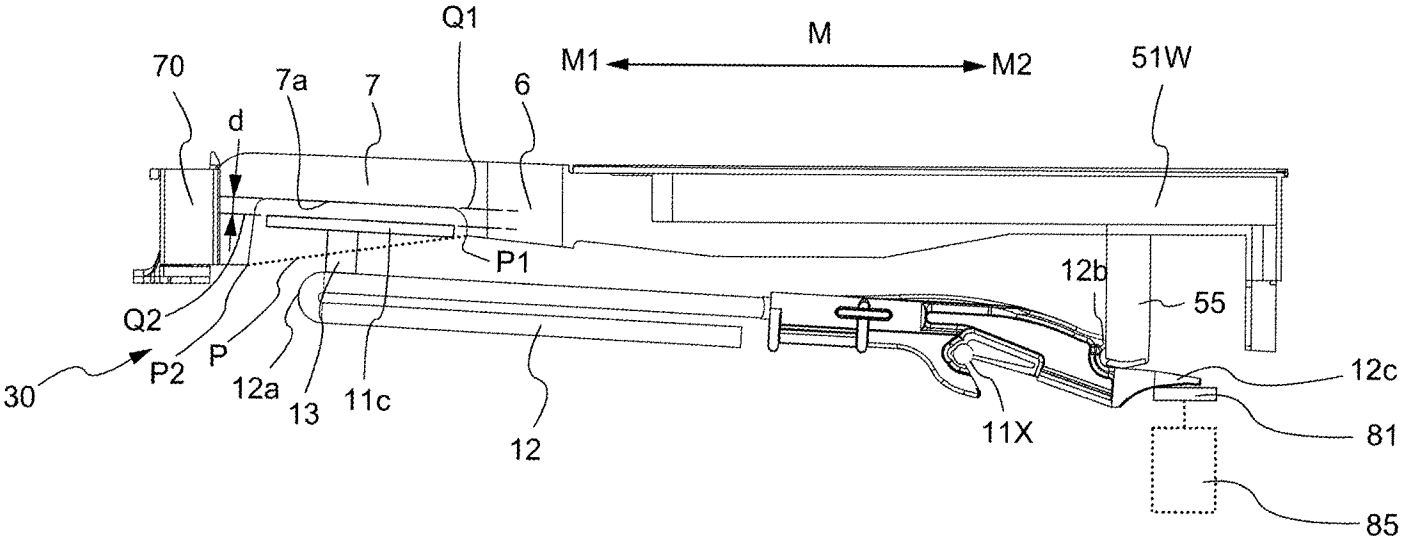

FIG. 6A is a side view showing a positional relationship between the white key 51W and the hammer 12 when the white key 51W is in an unstruck state. FIG. 6B is a side view showing a positional relationship between the white key 51W and the hammer 12 when the white key 51W is in a struck state. The hammer mechanism 30 is structured so as to include the hammer 12 operated according to a strike of the white key 51W and the hammer stopper 13 regulating the movement of the hammer. The hammer mechanism 30 further includes the supporting frame portion 11*c* and the supporting portion 14 in addition to these elements.

(Positional Relationship Between the Hammer Mechanism and the Depressed Portion)

The depressed portion 7*a* described above is caved in order to escape from (not to bump into) at least a part of the hammer stopper 13 which is in contact with the hammer 12 and the supporting frame 11*c* supporting the hammer stopper 13.

The supporting frame 11*c* is arranged substantially parallel to the depressed portion 7*a* when the white key 51W is in a stuck state (FIG. 6B). In this state, the most depressed surface denoted by a virtual line Q1 in the depressed portion 7*a* approaches the surface of the supporting frame 11*c* denoted by a virtual line Q2 by a distance d. Such a structure which makes the depressed portion 7*a* and the supporting frame 11*c* be positioned as close as possible when the white key 51W is struck allows the space under the key 51 to be efficiently used and the redundant space to be reduced to a value corresponding to the distance d. Note that it is not always necessary to arrange the supporting frame 11*c* and the depressed portion 7*a* in parallel as long as they are configured to approach each other as close as possible.

In addition, the hammer 12 possesses a sensor strike-transmitting portion 12*c* on the side of the key-longitude front direction M2 from the rotation axis 11X. A sensor 81 for sensing a strike (operation) of the key 51 is arranged under the sensor strike-transmitting portion 12*c*. The sensor 81 as well as a sound-source device 85 connected to the sensor 81 is explained below.

Figure 8:
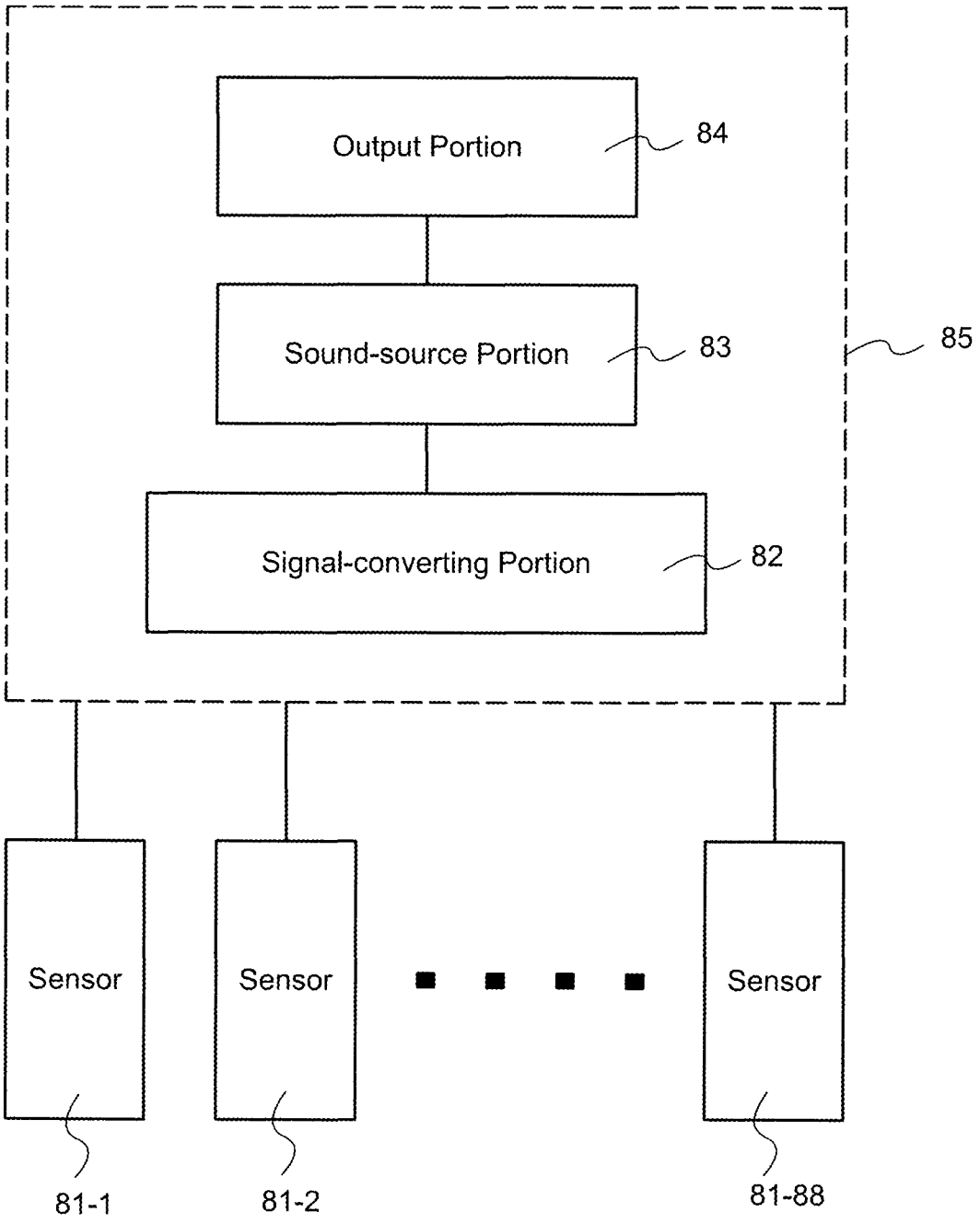
FIG. 8 is a block diagram showing a structure of a sound-source device.

FIG. 8 is a block diagram showing a structure of the sound-source device 85. The sound-source device 85 has a signal-converting portion 82, a sound-source portion 83, and an output portion 84. The sensors 81 are provided to the respective keys 51, detect the operation of the keys, and output signals corresponding to the detected content. In this example, the sensors 81 output signals in accordance with the striking amount of the key having three steps. It is possible to detect the rate of a key strike according to an interval between the signals.

The signal-converting portion 82 obtains the output signals of the sensors 81 (sensors 81-1 to 81-88 corresponding to 88 keys 51), generates operation signals corresponding to the operation state of each key 51, and outputs the operation signals. In this example, the operation signals are signals in a MIDI format. Therefore, the signal-converting portion 82 outputs a note-ON according to the key operation. At this time, a key number showing the operated key among the 88 keys 51 and velocity corresponding to the rate of the key strike are associated with the note-ON and output. The signal-converting portion 82 associates the key number with a note-OFF according to a key-releasing operation and outputs the note-OFF. Signals corresponding to other operations such as a pedal operation are input to the signal-converting portion 82, and these signals may be reflected in the operation signals.

The sound-source portion 83 generates sound-wave signals on the basis of the operation signals output from the signal-converting portion 82. The output portion 84 outputs the sound-wave signals generated by the sound-source portion 83. The sound-wave signals are output to a speaker or an output terminal for a sound-wave signal which are not illustrated, for example.

Here, turning to the explanation of FIG. 6B, the hammer mechanism 30 is configured so that a part thereof is positioned in the depressed portion 7*a* of the wide-width portion 7 when the white key 51W is in a struck state as described above. The state where a part of the hammer mechanism 30 is positioned in the depressed portion 7*a* means that the part of the hammer mechanism 30 is positioned in a region surrounded by a virtual line P (illustrated with a dotted line. The same is applied hereinafter) connecting one end portion P1 and the other end portion P2 of the depressed portion 7*a* in the key-longitude direction M and the depressed portion 7*a*.

Specifically, the hammer mechanism 30 is configured so that the hammer stopper 13 is arranged to be located in the depressed portion 7*a* of the wide-width portion 7 when the key 51 is in the struck state in the present embodiment (see FIG. 6B). In addition, the hammer stopper 13 is arranged so as to be positioned in the depressed portion 7*a* of the wide-width portion 7 even in the state where the key 51 is not struck in the present embodiment (see FIG. 6A). Note that the hammer mechanism 30 may be configured so that the hammer stopper 13 is not positioned in the depressed portion 7*a* of the wide-width portion 7 in the state where the key 51 is not struck but is positioned in the depressed portion 7*a* of the wide-width portion 7 after the key 51 is struck.

This hammer stopper 13 has a function to regulate an upper limit position of the tip portion 12*a* which ascends when a player strikes the white key 51W. Moreover, the hammer stopper 13 is provided so as to make contact with the hammer 12 in order to allow a player to obtain a feeling of striking a key of a ground piano when the player strikes the white key 51W.

(Positional Relationship of the Tip Portion of the Hammer and the Depressed Portion)

Figure 7A:
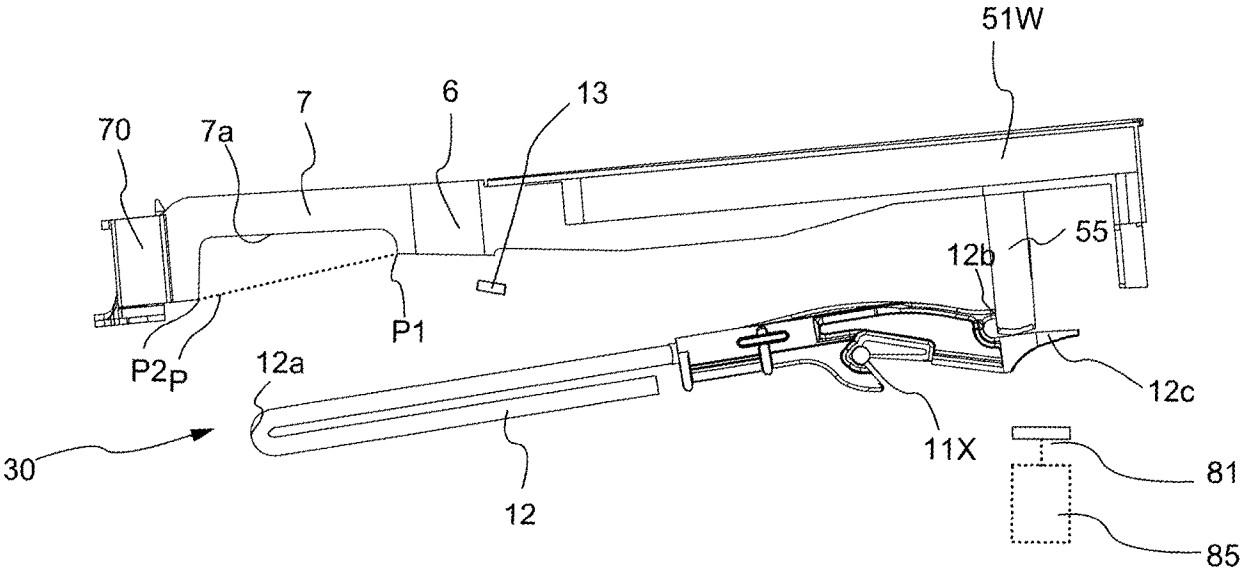
Figure 7B:
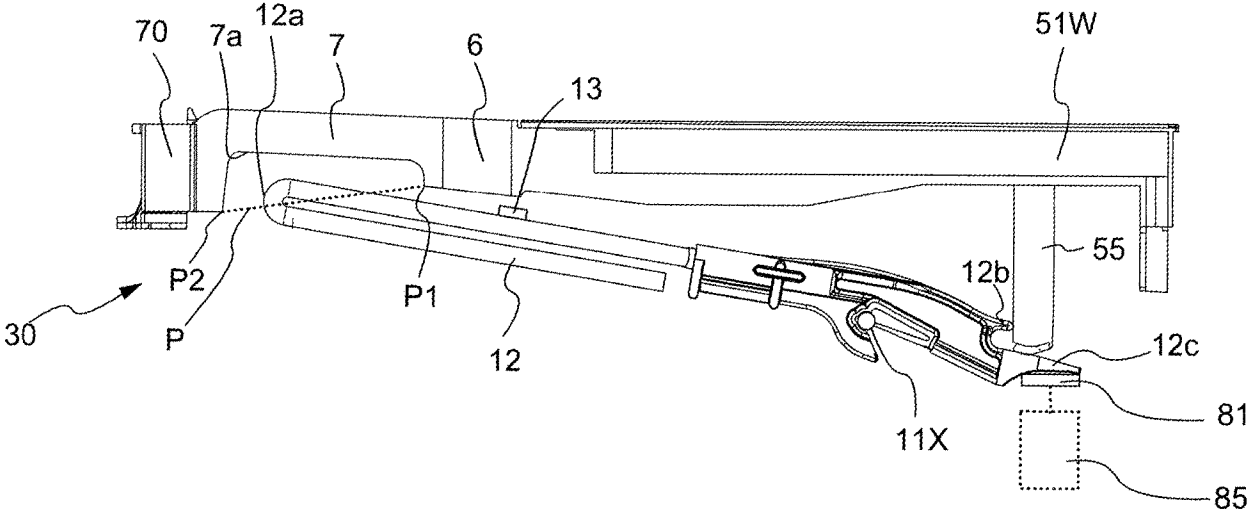

FIG. 7A and FIG. 7B are drawings of the keyboard device 100 according to a modified example of an embodiment of the present invention. FIG. 7A and FIG. 7B are side views showing a positional relationship between the white key 51W and the hammer 12 when the white key 51W is in an unstruck state and a struck state, respectively.

In this modified example, a part of the hammer 12 is positioned in the depressed portion 7*a* of the wide-width portion 7 in the state where the key 51 is struck (see FIG. 7B). However, a part of the hammer 12 may be located in the depressed portion 7*a* of the wide-width portion 7 in the state where the key 51 is not struck. In addition, the hammer 12 may be configured so that, although a part of the hammer 12 is not located in the depressed portion 7*a* of the wide-width portion 7 in the state where the key 51 is not struck, the part of the hammer 12 enters the depressed portion 7*a* of the wide-width portion 7 after the key 51 is struck (see FIG. 7A and FIG. 7B). Note that in the case of the structure of FIG. 7A and FIG. 7B, the position of the hammer stopper 13 is not in the depressed portion 7*a* but under the white key 51W.

According to the structure of the aforementioned embodiment, the depressed portion 7*a* is provided in the connection portion 52. A part of the hammer mechanism 30 is located in the depressed portion 7*a* when the white key 51W or the black key 51B is struck. The depressed portions 7*a* of the white key 51W and the black key 51B can be utilized as a space for receiving a part of the hammer mechanism 30, by which a wider rotation region of the hammer 12 can be secured. In addition, a heavy touch feeling of the key 51 can be realized.

Furthermore, according to the structure of the embodiment, the rigidity of the connection portion 52 in the vertical direction E is increased while the flexibility of the front-side narrow-width portion 6 and the back-side small-width portion 8 in the scale direction S is secured.

A structure obtained by adding or deleting a structural element or conducting a design change on a structural element on the basis of the structure explained as an embodiment of the present invention as well as a method to which a process is added, from which a process is omitted, or on which a condition change is performed are included in the range of the present invention as long as they involve the concept of the present invention.

It is properly understood that another effect different from that provided by the modes of the aforementioned embodiments is achieved by the present invention if the effect is obvious from the description in the specification or readily conceived by persons ordinarily skilled in the art.

What is claimed is:

1. A keyboard device comprising:

a key;

a connection portion connected between the key and a frame, the connection portion including:

a first region extending in a key-longitude direction and having a depressed portion caved upward; and a second region arranged so as to line up with the first region in the key-longitude direction, located in at least a part of a region other than the depressed portion, and having flexibility in a yawing direction; and a hammer mechanism operated according to a strike of the key, wherein a part of the hammer mechanism is positioned in the depressed portion in a state where the key is struck.

2. The keyboard device according to claim 1, wherein the hammer enters the depressed portion when the key is struck.

3. The keyboard device according to claim 1, wherein the hammer mechanism further comprises a stopper regulating movement of the hammer, and wherein the stopper is arranged in the depressed portion.

4. The keyboard device according to claim 1, wherein the second region has a width smaller than a width of the key in a scale direction, and wherein the first region has a width larger than a width of the second region in the scale direction.

5. The keyboard device according to claim 1, wherein the second region is arranged in a key-longitude front direction from the first region.

6. The keyboard device according to claim 1, wherein the second region is arranged in a key-longitude back direction from the first region.

7. The keyboard device according to claim 1, wherein the connection portion comprises two second regions, and wherein the two second regions are arranged in both of a key-longitude front direction and a key-longitude back direction from the first region.

8. The keyboard device according to claim 1, wherein the first region has a thickness smaller than a thickness of the second region in a vertical direction.

9. An electronic keyboard device comprising:

the keyboard device according to claim 1;

a sensor sensing an operation on the key; and a sound-source portion generating a sound-wave signal according to an output signal of the sensor.

* * * * *